US007163564B2

(12) United States Patent
Sibiet et al.

(10) Patent No.: US 7,163,564 B2
(45) Date of Patent: Jan. 16, 2007

(54) METHOD FOR BRIGHTENING VIRGIN MECHANICAL PULP

(76) Inventors: Jean Luc Sibiet, Hertogendalstraat 141 B 1160, Brussels (BE) B1160; Sundar Chellappan Jaya Krishnan, 3455 Durocher Street, Apt. 506, Montreal, Quebec (CA) H2X2C9; Joseph Najim, 147 Sylvan St., Unit 16B, Danvers, MA (US) 01923; Maurice Joseph Albert Hache, 262 Beacon St., Andover, MA (US) 01810

( * ) Notice: Subject to any disclaimer, the term of this patent is extended or adjusted under 35 U.S.C. 154(b) by 296 days.

(21) Appl. No.: 10/698,183

(22) Filed: Oct. 31, 2003
(Under 37 CFR 1.47)

(65) Prior Publication Data

US 2004/0117914 A1 Jun. 24, 2004

Related U.S. Application Data

(60) Provisional application No. 60/423,887, filed on Nov. 5, 2002.

(51) Int. Cl.
*D06L 3/10* (2006.01)
*C01B 17/66* (2006.01)
*D21C 3/12* (2006.01)

(52) U.S. Cl. ..... 8/101; 8/110; 423/515; 252/188.22; 162/7; 162/83

(58) Field of Classification Search ..... 8/101, 8/110; 162/7, 8, 9, 70, 71, 72, 78, 83, 84; 252/188.22; 423/515
See application file for complete search history.

(56) References Cited

U.S. PATENT DOCUMENTS

| | | | | |
|---|---|---|---|---|
| 2,707,144 | A | 4/1955 | Sparrow et al. | |
| 2,707,145 | A | 4/1955 | Sparrow et al. | |
| 2,707,146 | A | 4/1955 | Burton et al. | |
| 3,167,515 | A * | 1/1965 | Hinckley et al. | 252/188.22 |
| 3,709,779 | A | 1/1973 | Gupta | |
| 3,985,674 | A * | 10/1976 | Ellis et al. | 252/188.24 |
| 4,804,440 | A | 2/1989 | Liebergott et al. | |
| 4,859,447 | A * | 8/1989 | Sanglet | 423/515 |
| 4,865,690 | A * | 9/1989 | Bernard et al. | 162/4 |
| 4,919,755 | A | 4/1990 | Mansson | |
| 5,169,555 | A * | 12/1992 | Mikulski et al. | 252/188.26 |
| 5,336,479 | A * | 8/1994 | Munroe | 423/515 |
| 5,429,716 | A * | 7/1995 | Hache et al. | 162/7 |
| 5,449,436 | A | 9/1995 | Bourson et al. | |
| 5,622,597 | A * | 4/1997 | Callen et al. | 162/5 |
| 6,217,621 | B1 * | 4/2001 | Modebelu et al. | 8/102 |
| 7,029,554 | B1 * | 4/2006 | Goda | 162/80 |
| 2004/0000380 | A1 * | 1/2004 | Goda | 162/24 |
| 2004/0211533 | A1 * | 10/2004 | Huang et al. | 162/7 |

FOREIGN PATENT DOCUMENTS

| | | |
|---|---|---|
| EP | 0 191756 | 8/1986 |
| EP | 0 577 396 | 1/1994 |
| WO | WO 9011403 | 10/1990 |
| WO | WO 9011403 A1 * | 10/1990 |
| WO | WO 0053844 | 9/2000 |

OTHER PUBLICATIONS

Carlton W. Dence and Douglas W. Reeve; "Pulp Bleaching Principles and Practice"; *Tappi Press*; (1996).

* cited by examiner

*Primary Examiner*—Eric Hug
*Assistant Examiner*—Dennis Cordray
(74) *Attorney, Agent, or Firm*—Kenneth Crimaldi

(57) ABSTRACT

A method for brightening virgin mechanical pulp. The method comprises combining: (i) an aqueous solution comprising sodium borohydride and sodium hydroxide; and (ii) an aqueous solution comprising sodium bisulfite, in a chemical mixer and adding output of the chemical mixer to an aqueous slurry of virgin mechanical pulp. The ratio of (moles bisulfite–moles hydroxide)/moles borohydride is from 0 to 7.8.

7 Claims, No Drawings

METHOD FOR BRIGHTENING VIRGIN MECHANICAL PULP

CROSS REFERENCE TO RELATED PATENT APPLICATIONS

This is a non-provisional application of prior pending U.S. provisional application Ser. No. 60/423,887 filed Nov. 5, 2002.

This invention relates generally to a method for brightening virgin mechanical wood pulp.

Hydrosulfite generated from bisulfite and borohydride has been used to bleach mechanical wood pulp, as described in *Hydrosulfite* (*Dithionite*) *Bleaching*, Pulp Bleaching (Chapter V2), C. W. Dence & D. W. Reeve, eds., Tappi Press (1996). However, this reference describes the reaction of bisulfite and borohydride only in terms of the theoretical stoichiometry in which 8 moles of unconsumed bisulfite are required per mole of borohydride, and does not suggest that effective bleaching can be accomplished at a lower ratio.

The problem addressed by this invention is to find a more efficient process for reductive bleaching of mechanical wood pulp.

STATEMENT OF THE INVENTION

This invention is directed to a method for brightening virgin mechanical pulp. The method comprises combining: (i) an aqueous solution comprising sodium borohydride and sodium hydroxide; and (ii) an aqueous solution comprising sodium bisulfite, in a chemical mixer and adding output of the chemical mixer to an aqueous slurry of virgin mechanical pulp. The ratio of (moles bisulfite−moles hydroxide)/moles borohydride is from 0 to 7.8.

In another embodiment of the invention, at least one chelant is added to the pulp slurry.

DETAILED DESCRIPTION OF THE INVENTION

All percentages are expressed as weight percentages based on the entire composition, unless specified otherwise. The term "virgin mechanical pulp" refers to mechanical wood pulp that has not been subjected previously to reductive or oxidative bleaching. A "chelant" is a substance capable of forming more than one coordinate bond with a metal ion in aqueous solution, especially with transition metal ions, including, e.g., iron, manganese, copper and chromium. The term "pre-mix" refers to a pulp brightening process in which borohydride and bisulfite are mixed prior to addition to the pulp. The term "E-pre-mix" refers to a pre-mix process in which at least one chelant is added.

Dithionite ion, also referred to as hydrosulfite, can be produced by the reaction between bisulfite and borohydride ions, according to the following theoretical equation:

$$BH_4^- + 8HSO_3^- + H^+ \rightarrow 4S_2O_4^{-2} + B(OH)_3 + 5H_2O$$

The yield is somewhat less than 100% due to competing reactions, including that of borohydride with water, but is most often better than 85%. Since the exact mechanism of the reaction has not been fully characterized, this invention is not limited to reduction by dithionite ion, and other species present in the reaction mixture also may act as reducing agents. When the amount of bisulfite is below 8 moles per mole of borohydride, the theoretical reaction cannot proceed to completion. Without wishing to be bound by theory, it is believed that use of less than the theoretical amount of bisulfite results in a mixture containing hydrosulfite, borohydride, and possibly other species.

In a preferred embodiment of the invention, borohydride is added in the form of an aqueous solution containing sodium borohydride and sodium hydroxide. In this embodiment, some of the bisulfite is consumed in a neutralization reaction with the hydroxide ion. In some applications, hydroxide ion present in borohydride solutions is neutralized by acid added to the bisulfite solution. In such a case, to the extent that the hydroxide initially present in the borohydride solution has been neutralized, it will not consume bisulfite, and will not be included in the ratio calculation. As described above, the theoretical reaction of borohydride and bisulfite requires 8 moles of unconsumed bisulfite per mole of borohydride, i.e., the ratio (moles bisulfite−moles hydroxide)/moles borohydride is at least 8. The present invention uses a ratio from 0 to 7.8. Preferably, the ratio is no more than 7.5, more preferably no more than 7, and most preferably no more than 6.8. Preferably, the ratio is at least 4, more preferably at least 5, more preferably at least 6, and most preferably at least 6.5. Use of any ratio lower than the theoretical value of 8 produces cost savings from decreased usage of bisulfite, relative to the conventional stoichiometric process. The data provided below in the Examples demonstrates, unexpectedly, that these cost savings can be achieved without substantially sacrificing performance.

In one embodiment of the invention, bisulfite is generated by combining water and sodium metabisulfite, $Na_2S_2O_5$. The aqueous sodium bisulfite preferably is about 20% to about 45% active by weight. A preferred borohydride composition for use in accordance with the methods of the invention is in liquid form and comprises about 1% to about 36% active sodium borohydride and about 30 to about 40% NaOH or $Na_2CO_3$ (also known as soda ash), all by weight. A particularly preferred borohydride composition comprising 12% active sodium borohydride and 40% NaOH is commercially available from Rohm and Haas Company under the trademark Borol™ solution. (For example, 100 g of Borol™ solution contains 12 g sodium borohydride, 40 g NaOH, and 48 g $H_2O$). When the sodium borohydride solution contains sodium hydroxide, e.g., Borol™ solution, the theoretical equation for reaction with bisulfite is as follows $$[NaBH_4 + 3.2NaOH] + 11.2NaHSO_3 \rightarrow 4Na_2S_2O_4 + (NaBO_2 + 3.2Na_2SO_3 + 9.2H_2O)$$

In this case, where there are 3.2 moles of hydroxide per mole of borohydride, and the hydroxide has not been neutralized with a mineral acid, the ratio of bisulfite unconsumed by hydroxide to borohydride is (11.2−3.2)/1=8.0, i.e., the theoretical ratio.

The borohydride solution and the bisulfite solution are mixed in a chemical mixer. Preferably, the mixer is an in-line static mixer. Typical in-line static mixers have from 2 to 24 internal elements, preferably from 2 to 6 internal elements. The length of the piping from the mixer to the point of addition to the pulp slurry also may affect the mixing; preferably this length is at least 1 m, more preferably at least 1.5 m. The number of elements, the diameter of the mixer and the length of piping required to achieve good mixing, i.e., to produce a substantially homogeneous mixture, can be determined easily from the flow parameters and fluid properties of each particular system. For example, in one method dye is added to one of the solutions and good mixing is assessed by visible determination that the color of the output is uniform. In another method, the pH of the pulp slurry after addition of the mixed borohydride and bisulfite solutions is measured; a stable pH value is an indication of good mixing, as are consistent bleaching results. Preferably, if mixing is insufficient, the borohydride and bisulfite solutions are diluted. Preferably, the borohydride and bisulfite solutions are mixed at a temperature in the range from 4° C. to 50° C., more preferably from 10° C. to 35° C.

Preferably, the mixed borohydride and bisulfite solutions are added to the pulp slurry directly, or by storing the output in a vessel for later addition to the pulp slurry. In one preferred embodiment, the output of the mixer is stored in a vessel and added to the pulp slurry within 12 hours of mixing, more preferably within 6 hours, more preferably within 3 hours, more preferably within 1 hour, and most preferably within ½ hour of mixing. In another preferred embodiment, the mixer output is added directly through piping which carries the output to the pulp slurry in less than 15 minutes, more preferably less than 10 minutes, and most preferably less than 5 minutes. Preferably, the amount of borohydride added to the pulp slurry, measured as the percentage of sodium borohydride relative to the dried fiber content of the pulp, is at least 0.015%, more preferably at least 0.03%, and most preferably at least 0.054%. Preferably, the amount of borohydride added to the pulp slurry, measured as the percentage of sodium borohydride relative to the dried fiber content of the pulp, is no more than 0.12%, more preferably no more than 0.09%, and most preferably no more than 0.066%. In a preferred embodiment of the invention, a 12% aqueous sodium borohydride solution is used, e.g., Borol™ solution. In this embodiment, the weight of the solution used, measured as a percentage of the dried fiber content of the pulp, is at least 0.125%, more preferably at least 0.25%, and most preferably at least 0.45%. Preferably, the weight of solution used, measured as a percentage of the dried fiber content of the pulp, is no more than 1%, more preferably no more than 0.75%, and most preferably no more than 0.55%.

Preferably, the mixed borohydride and bisulfite solutions that are the output of the mixer are added to the pulp slurry after the slurry has been screened and thickened and is ready for paper-making, i.e., after the deckers in a typical pulp mill. In one preferred embodiment of the invention, the mixed solutions are added to the MC stand pipe in which pulp slurry accumulates prior to being pumped to the up-flow tower or the chest. In another preferred embodiment, the mixed solutions are added to wood chips or fibers in the de-fibering stage, for example in the refiners or grinders.

In one preferred embodiment of the invention, at least one chelant is added to the pulp slurry along with the mixed borohydride and bisulfite solutions. The chelant may be added either to the output from the mixer, or to either of the input streams to the mixer. Suitable chelants include, e.g., DTPA, STPP, EDTA, and phosphorus-containing chelants, e.g., phosphonate- and phosphonic-acid chelants. The amount of chelant added to the pulp slurry, measured on an "as is" basis, i.e., as the percentage of solid chelant or commercial chelant solution relative to the dried fiber content of the pulp, is from 0.05% to 0.4%, more preferably from 0.1% to 0.3%, and most preferably from 0.17% to 0.23%. Typically, STPP is available commercially as a solid, and EDTA and DTPA as their aqueous solutions. Commercial EDTA solution typically is 38% EDTA.

EXAMPLES

Example 1

Laboratory Studies

Pressurized ground wood (PGW) pulp samples from a North American mill were used for the study. Pre-mix, E pre-mix and Borol™-generated hydrosulfite (BGH) bleaching studies were conducted on this pulp. BGH was produced at a molar ratio, (bisulfite—hydroxide)/borohydride, of 8. Pre-mix was performed at molar ratios of 6.8 and 8.8, and E pre-mix at a molar ratio of 6.8. The studies were performed at 3.5% consistency, 160° F. and a retention time of 60 minutes. The initial pulp brightness was 59.2% ISO. Table I shows the result of a comparison between the BGH and pre-mix processes. The bleaching responses of the BGH and pre-mix processes were similar.

BGH Bleaching

Based on consistency, 7 g O.D. pulp (pulp weighed on an oven-dried basis) was placed in heavy gauge polyethylene bags. The bags were sealed under nitrogen, shaken vigorously to disperse the pulp fiber, and preheated in a constant temperature bath at 160° F. for 10 minutes. Sodium hydrosulfite solution was generated from Borol™ solution/$NaHSO_3/H_2SO_4$. The solution was analyzed for sodium hydrosulfite by titration with a standard iodine solution (TAPPI standard T-622). Based on the analysis, the required volume of bleach solution was calculated, and is reported as % hydrosulfite on a dry pulp basis. Bleach response was determined by adding the bleach under nitrogen and keeping the pipette below the surface of the pulp. Each bag was resealed, shaken thoroughly to mix, and returned to the constant temperature bath for 60 minutes. At the end of the bleaching period each bag was removed from the bath and the pH was taken. The pulp was then diluted to 1% using deionized water prior to filtration. One handsheet was made from each run and air dried overnight at 50% relative humidity. Brightness readings were done using a Technibrite™ ERIC 950 and are the average of five readings from each 7 g O.D. handsheet.

Pre-Mix Bleaching Process

Based on consistency, 7 g O.D. pulp was placed in heavy gauge polyethylene bags. The bags were sealed under nitrogen, shaken vigorously to disperse the pulp fiber, and preheated in a constant temperature bath at 160° F. for 10 minutes. Pre-mix solutions were generated from Borol™ solution and $NaHSO_3$ (SBS). In the method of generating the pre-mix solution, sodium bisulfite powder was added to water in a round bottom flask and stirred until the sodium bisulfite powder had completely dissolved. Borol™ solution was then immediately added under an inert atmosphere and under very rapid stirring in order to generate a completely formed pre-mix solution. Based on the borohydride concentration of each solution, the required volume of pre-mix solutions were calculated. A bleach response was carried out by adding the pre-mix solution under nitrogen and keeping the pipette below the surface of the pulp. Each bag was resealed, shaken thoroughly to mix, and returned to the constant temperature bath for 60 minutes. At the end of the bleaching period each bag was removed from the bath and the pH was taken. The pulp was then diluted to 1% using deionized water. One handsheet was made from each run and air dried overnight at 50% relative humidity. Brightness readings were done using a Technibrite™ ERIC 950 and are the average of five readings from each 7 g O.D. handsheet.

E Pre-Mix Bleaching Process

This was identical to pre-mix process except that the required amount of EDTA was added to sodium bisulfite solution in generating the pre-mix solution.

TABLE I

Laboratory bleaching response of BGH and pre-mix process.

| Chemical Dosage | | Bleaching Process | Initial pH | Final pH | Bright. (% ISO) |
|---|---|---|---|---|---|
| 0.25% | | BGH | 5.2 | 5.2 | 62.4 |
| — | 0.125% Borol ™ solution, 0.415% SBS | Pre-mix 6.8:1 | 5.2 | 5.7 | 62.4 |
| — | 0.125% Borol ™ solution, 0.495% SBS | Pre-mix 8.8:1 | 5.2 | 5.5 | 62.6 |
| 0.50% | | BGH | 5.2 | 5.3 | 64.6 |
| — | 0.250% Borol ™ solution, 0.825% SBS | Pre-mix 6.8:1 | 5.2 | 6.0 | 64.4 |
| — | 0.250% Borol ™ solution, 0.990% SBS | Pre-mix 8.8:1 | 5.2 | 5.9 | 64.8 |
| 0.75% | | BGH | 5.2 | 5.4 | 65.2 |
| — | 0.375% Borol ™ solution, 1.240% SBS | Pre-mix 6.8:1 | 5.2 | 6.2 | 65.1 |
| — | 0.375% Borol ™ solution, 1.485% SBS | Pre-mix 8.8:1 | 5.2 | 6.2 | 65.3 |

The effect of adding EDTA to the pre-mix solution was studied (E pre-mix process). EDTA maximizes the bleaching efficiency. Table II shows the comparison of E pre-mix and pre-mix processes. EDTA solution dosage was 40% on the Borol™ solution dosage in the E pre-mix process.

TABLE II

Laboratory bleaching comparison of pre-mix and E pre-mix process

| Chemical Dosage | Bleaching Process | Initial pH | Final pH | Bright. (% ISO) |
|---|---|---|---|---|
| 0.375% Borol ™ solution, 1.240% SBS | Pre-mix 6.8:1 | 4.9 | 5.9 | 64.4 |
| 0.375% Borol ™ solution, 1.240% SBS | E Pre-mix 6.8:1 | 4.9 | 5.8 | 65.2 |

Example 2

Mill Trial

BGH Bleaching

The Borol™ bleaching unit generated 3% hydrosulfite solution. Sodium bisulfite was mixed with water, immediately followed by the addition of sulfuric acid. The diluted mixture was passed through a Teflon-coated static mixer. Sulfuric acid flow was controlled by the reaction pH. The reaction pH set point was at 6.3. Borol™ solution was injected along with the recirculation bleach stream to the diluted sodium bisulfite/acid solution mixture and passed through an in-line static mixer. The product sodium hydrosulfite solution flowed to a degas tank where the hydrogen gas generated during BGH generation was vented out of the system to atmosphere. The hydrosulfite solution was passed through a heat exchanger to maintain the bleach solution temperature at 75° F. Finally caustic was added to the hydrosulfite solution prior to storage to adjust the solution pH to 9.3 for stability purposes. The production rate of the unit was controlled by a set point from the bleach storage tank level on the process controller.

Pre-Mix Bleaching Process

Based on the Borol™ solution dosage for the bleaching application and the selected molar ratio during the pre-mix process the sodium bisulfite dosage was determined. The molar ratio of (bisulfite-hydroxide)/borohydride varied from 4.8 to 8.8 during the trial. The required flow of the Borol™ solution and sodium bisulfite solution was calculated based on the tonnage of the pulp bleached with pre-mix solution. Borol™ solution and sodium bisulfite solution were supplied in totes and the chemical flows was controlled by a variable speed pump. The flow rate was checked using a calibration column setup. Borol™ solution was diluted to about 2% of its original concentration and the sodium bisulfite solution was diluted to about 5% bisulfite. The diluted Borol™ solution in the main stream was blended with diluted sodium bisulfite solution in the side stream in a T-type connection. The chemicals flowed through a Kenics™ static mixer (model KME-PVC 4, 4 elements, 1 inch (2.54 cm) diameter, and 9¼ inch (23.5 cm) length) just prior to injecting to the pulp slurry in the MC stand pipe after the decker. The distance between the T-type connection, at which the bisulfite solution side stream was introduced into the borohydride stream, and the static mixer was less than one foot (0.30 m) (estimated). The distance between the static mixer and the bleaching injection point was about 6 feet (1.8 m) (estimated).

Base-line data were collected first at 0.75% BGH dosage (percent of hydrosulfite based on dry pulp). Immediately following the BGH baseline data collection, the pre-mix process was run and the results compared with the base-line. The pre-mix process was run at two different molar ratios of (bisulfite-hydroxide)/borohydride, first at a 8.8:1 molar ratio, followed by 6.8:1 molar ratio. The Borol™ solution dosage was 0.375%. Brightness was measured on the unbleached sample collected at the decker and the bleached pulp sample collected just before the pulp entering the up-flow hydro tower. The retention time was about 15 minutes at 165° F. Samples were collected every 30 minutes during the trial.

The results comparing the BGH process and the pre-mix process are presented in Table III. It was demonstrated that the pre-mix performance is similar to BGH and the optimum molar ratio for the pre-mix is 6.8:1.

TABLE III

Mill trial - Comparison of BGH (0.750% ) with the pre-mix process (0.375% Borol ™ solution) at 8.8:1 and 6.8:1 molar ratios*

| | | Unbleached | | Bleached | | |
|---|---|---|---|---|---|---|
| Process | Chemical Dosage | Brightness (% ISO) | pH | Brightness (% ISO) | pH | Brightness Gain |
| BGH | 0.750% | 57.9 | 5.2 | 67.6 | 5.9 | |
| BGH | 0.750% | 58.1 | 5.2 | 68.0 | 5.6 | |
| BGH | 0.750% | 57.9 | 5.2 | 68.2 | 5.4 | |
| BGH | 0.750% | 58.2 | 5.3 | 68.1 | 5.3 | |
| BGH | 0.750% | 58.2 | 5.3 | 68.0 | 5.6 | |
| | | 58.1 | 5.2 | 68.0 | 5.6 | 9.9 |
| pre-mix 8.8:1 | 0.375% Borol ™ solution, 1.485% SBS | 58.0 | 5.3 | 67.5 | 6.5 | |
| pre-mix 8.8:1 | 0.375% Borol ™ solution, 1.485% SBS | 58.2 | 5.3 | 68.0 | 6.5 | |

TABLE III-continued

| Mill trial - Comparison of BGH (0.750% ) with the pre-mix process (0.375% Borol ™ solution) at 8.8:1 and 6.8:1 molar ratios* | | | | | | |
|---|---|---|---|---|---|---|
| | | Unbleached | | Bleached | | |
| Process | Chemical Dosage | Brightness (% ISO) | pH | Brightness (% ISO) | pH | Brightness Gain |
| pre-mix 8.8:1 | 0.375% Borol ™ solution, 1.485% SBS | 58.2 | 5.3 | 67.6 | 6.5 | |
| pre-mix 8.8:1 | 0.375% Borol ™ solution, 1.485% SBS | 58.1 | 5.3 | 67.6 | 6.5 | |
| pre-mix 8.8:1 | 0.375% Borol ™ solution, 1.485% SBS | 58.1 | 5.3 | 67.8 | 6.5 | |
| | | 58.1 | 5.3 | 67.7 | 6.5 | 9.6 |
| pre-mix 6.8:1 | 0.375% Borol ™ solution, 1.238% SBS | 58.3 | 5.3 | 67.7 | 6.7 | |
| pre-mix 6.8:1 | 0.375% Borol ™ solution, 1.238% SBS | 57.8 | 5.3 | 68.1 | 6.7 | |
| pre-mix 6.8:1 | 0.375% Borol ™ solution, 1.238% SBS | 57.2 | 5.3 | 67.2 | 6.5 | |
| | | 57.8 | 5.3 | 67.7 | 6.7 | 9.9 |

*Molar ratio of (bisulfite − hydroxide)/borohydride

Table IV shows the comparison of BGH at 0.50% with pre-mix at 0.25% Borol™ solution and 0.825% SBS (6.8:1 molar ratio).

TABLE IV

| Mill trial - Comparison of BGH (0.5%) with Pre-mix process (0.25% Borol ™ solution at 6.8:1 molar ratio) | | | | | | |
|---|---|---|---|---|---|---|
| | | Unbleached | | Bleached | | |
| Process | Chemical Dosage | Brightness (% ISO) | pH | Brightness (% ISO) | pH | Brightness Gain |
| BGH | 0.5% | 58.5 | 5.3 | 68.2 | 6.2 | |
| BGH | 0.5% | 58.4 | 5.3 | 68.0 | 6.1 | |
| BGH | 0.5% | 58.8 | 5.4 | 68.3 | 6.2 | |
| BGH | 0.5% | 58.8 | 5.4 | 68.2 | 6.1 | |
| | | 58.6 | 5.4 | 68.2 | 6.2 | 9.6 |
| pre-mix 6.8:1 | 0.25% Borol ™ solution, 0.825% SBS | 57.2 | — | 66.9 | 6.2 | |
| pre-mix 6.8:1 | 0.25% Borol ™ solution, 0.825% SBS | 57.6 | 5.4 | 67.2 | 6.1 | |
| pre-mix 6.8:1 | 0.25% Borol ™ solution, 0.825% SBS | 58.4 | 5.4 | 67.7 | 6.4 | |
| pre-mix 6.8:1 | 0.25% Borol ™ solution, 0.825% SBS | 58.3 | 5.4 | 67.7 | 6.3 | |
| | | 57.9 | 5.4 | 67.4 | 6.3 | 9.5 |

The performance of the pre-mix bleaching at the suction of the MC pump was studied during an extended trial. Table V shows the results. The data show that it is possible to run the pre-mix process at a lower molar ratio of (bisulfite-hydroxide)/borohydride (4.8:1) and still achieve a substantial brightness gain, although better results were obtained when the molar ratio for the pre-mix was 6.8:1.

TABLE V

| Effect of adding the pre-mix solution at the suction of the MC pump | | | | | | |
|---|---|---|---|---|---|---|
| | | Unbleached | | Bleached | | |
| Process | Chemical Dosage | Bright. (% ISO) | pH | Bright. (% ISO) | pH | Bright. Gain |
| BGH | 0.85% | 60.5 | 4.9 | 68.3 | 5.9 | |
| | 0.85% | 60.2 | 4.9 | 69.3 | 6.0 | |
| | 0.85% | 60.2 | 4.8 | 68.5 | 5.8 | |
| | 0.85% | 60.5 | 4.9 | 68.7 | 5.8 | |
| | 0.85% | 59.9 | 4.9 | 68.7 | 5.9 | |
| | | 60.3 | | 68.7 | | 8.4 |
| Pre-mix 8.8:1 | 0.425% Borol ™ solution, 1.683% SBS | 60.4 | 4.9 | 68.8 | 6.2 | |
| | 0.425% Borol ™ solution, 1.683% SBS | 60.7 | 4.9 | 68.9 | 6.2 | |
| | 0.425% Borol ™ solution, 1.683% SBS | 60.3 | 4.8 | 68.8 | 6.1 | |
| | 0.425% Borol ™ solution, 1.683% SBS | 60.5 | 4.9 | 69.1 | 6.2 | |
| | 0.425% Borol ™ solution, 1.683% SBS | 60.5 | 4.9 | 69.2 | 6.2 | |
| | | 60.5 | | 69.0 | | 8.5 |
| Pre-mix 6.8:1 | 0.425% Borol ™ solution, 1.40% SBS | 60.3 | 4.9 | 68.6 | 6.2 | |
| | 0.425% Borol ™ solution, 1.40% SBS | 60.4 | 5.0 | 68.7 | 6.2 | |
| | 0.425% Borol ™ solution, 1.40% SBS | 60.1 | 4.9 | 68.7 | 6.2 | |
| | 0.425% Borol ™ solution, 1.40% SBS | 60.2 | 4.9 | 68.6 | 6.2 | |
| | | 60.3 | | 68.7 | | 8.4 |
| Pre-mix 4.8:1 | 0.425% Borol ™ solution, 1.12% SBS | 60.0 | 4.9 | 67.4 | 6.5 | |
| | 0.425% Borol ™ solution, 1.12% SBS | 60.4 | 4.9 | 67.7 | 6.4 | |
| | 0.425% Borol ™ solution, 1.12% SBS | 60.5 | 4.9 | 67.9 | 6.4 | |
| | | | | 68.4 | 6.4 | |
| | | 60.3 | | 67.9 | | 7.6 |

Good mixing of the pre-mix solution with the pulp was achieved, as demonstrated by the steady pH reading and uniformity in bleached pulp brightness reported in Tables III–V.

The invention claimed is:

1. A method for brightening virgin mechanical pulp; said method comprising combining: (i) an aqueous solution comprising sodium borohydride and sodium hydroxide; and (ii) an aqueous solution comprising sodium bisulfite, in a chemical mixer and adding output of the chemical mixer to an aqueous slurry of virgin mechanical pulp;

wherein a ratio of (moles bisulfite−moles hydroxide)/moles borohydride in from 4 to 7.5, and the output of the chemical mixer is added to the pulp slurry within 12 hours of mixing.

2. The method of claim 1 in which said ratio is from 5 to 7.

3. The method of claim 2 in which the output of the chemical mixer is added to the pulp slurry within 3 hours of mixing.

4. The method of claim 3 in which the chemical mixer is an in-line static mixer, and the output of the chemical mixer is substantially homogeneous prior to addition to the pulp slurry.

5. The method of claim 4 in which a ratio of sodium borohydride to pulp is from 0.015 weight % to 0.12 weight %, and said aqueous solution comprising sodium borohydride and sodium hydroxide comprises about 12% sodium borohydride and about 40% sodium hydroxide.

6. The method of claim 1 further comprising addition of at least one chelant to the pulp slurry.

7. The method of claim 6 in which the output of the chemical mixer is added to the pulp slurry within 3 hours of mixing.

* * * * *